US010995538B2

(12) United States Patent
Hall et al.

(10) Patent No.: US 10,995,538 B2
(45) Date of Patent: May 4, 2021

(54) RETROFITTABLE MOTORIZED PULLEY SLIDING WINDOW OR DOOR SYSTEM

(71) Applicants: David R. Hall, Provo, UT (US); Jerome Miles, Spanish Fork, UT (US); Nathan Davis, Bountiful, UT (US)

(72) Inventors: David R. Hall, Provo, UT (US); Jerome Miles, Spanish Fork, UT (US); Nathan Davis, Bountiful, UT (US)

(73) Assignee: Hall Labs LLC, Provo, UT (US)

( * ) Notice: Subject to any disclaimer, the term of this patent is extended or adjusted under 35 U.S.C. 154(b) by 209 days.

(21) Appl. No.: 15/821,988

(22) Filed: Nov. 24, 2017

(65) Prior Publication Data

US 2019/0003237 A1 Jan. 3, 2019

Related U.S. Application Data

(60) Provisional application No. 62/528,288, filed on Jul. 3, 2017.

(51) Int. Cl.
*E05F 15/643* (2015.01)

(52) U.S. Cl.
CPC ..... *E05F 15/643* (2015.01); *E05Y 2201/668* (2013.01); *E05Y 2400/66* (2013.01); *E05Y 2600/46* (2013.01); *E05Y 2800/21* (2013.01); *E05Y 2900/132* (2013.01); *E05Y 2900/148* (2013.01)

(58) Field of Classification Search
CPC ..... E05F 15/635; E05F 15/643
See application file for complete search history.

(56) References Cited

U.S. PATENT DOCUMENTS 3,775,906 A * 12/1973 Dougherty ..... E05F 15/635 49/358
6,092,338 A * 7/2000 Crowner ..... E05F 15/643 49/360
6,233,878 B1 * 5/2001 Krahenbuhl ..... E05F 15/632 52/64
6,481,160 B1 * 11/2002 Kowalczyk ..... E05F 3/224 49/333
6,581,332 B1 * 6/2003 Kim ..... E05F 15/77 49/358
7,124,469 B2 * 10/2006 Tsekhanovsky ..... E05F 1/16 16/79

(Continued)

FOREIGN PATENT DOCUMENTS

WO WO-2008015300 A1 * 2/2008 ..... E05F 15/635

*Primary Examiner* — Catherine A Kelly

(57) ABSTRACT

Devices, systems, and methods for a frame with a slidable segment are disclosed. The slidable segment is slidably mounted within the frame. A first motor is coupled to the slidable segment. A first pulley is affixed to and driven by the first motor. A first end of a first wire is affixed to a first vertical member of the frame. A second end of the first wire is affixed to a second vertical member of the frame. The first wire wraps around the first pulley at least once. Driving the first pulley in a first direction causes the first pulley to pull on the first vertical member such that the slidable segment slides towards the first vertical member. Driving the first pulley in a second direction causes the first pulley to pull on the second vertical member such that the slidable segment slides towards the second vertical member.

13 Claims, 6 Drawing Sheets

(56) References Cited

U.S. PATENT DOCUMENTS

| | | | | |
|---|---|---|---|---|
| 8,464,470 | B2 * | 6/2013 | Katagata | B61B 1/02 49/360 |
| 9,452,761 | B2 * | 9/2016 | Romero | B61B 1/02 |
| 10,151,133 | B2 * | 12/2018 | Dieners | E05F 15/635 |
| 2005/0252085 | A1 * | 11/2005 | Chang | E05F 1/025 49/73.1 |
| 2006/0150520 | A1 * | 7/2006 | Hamazaki | E05B 65/08 49/449 |
| 2017/0101816 | A1 * | 4/2017 | Kozonasky | E05F 15/77 |
| 2018/0044966 | A1 * | 2/2018 | Brand | E05F 15/643 |
| 2019/0003235 | A1 * | 1/2019 | Hall | E05F 15/77 |
| 2019/0003236 | A1 * | 1/2019 | Hall | E06B 3/4609 |
| 2019/0040671 | A1 * | 2/2019 | Hall | E05F 15/71 |
| 2019/0162007 | A1 * | 5/2019 | Hall | E06B 3/4636 |
| 2019/0162009 | A1 * | 5/2019 | Hall | E05F 15/72 |
| 2019/0309559 | A1 * | 10/2019 | Hall | F24F 11/74 |
| 2019/0309560 | A1 * | 10/2019 | Hall | E05F 15/71 |
| 2019/0309561 | A1 * | 10/2019 | Hall | E05F 15/635 |
| 2019/0309562 | A1 * | 10/2019 | Hall | E05F 15/635 |

* cited by examiner

RETROFITTABLE MOTORIZED PULLEY SLIDING WINDOW OR DOOR SYSTEM

RELATED APPLICATIONS

This application is a continuation-in-part of U.S. Patent Application No. 62/528,288, filed Jul. 3, 2017, which is hereby incorporated by reference herein in its entirety.

FIELD OF THE INVENTION

The devices, systems, and methods described herein relate generally to the Internet of Things. More particularly, the devices, systems, and methods described herein relate to smart home devices.

BACKGROUND

Many improvements and developments have been made in the field of Smart Home devices. However, many devices, especially existing devices (such as windows and doors, for example) in a residence or business, simply aren't smart and/or weren't designed to be smart. It is desirable to be able to convert otherwise dumb devices into smart devices.

SUMMARY

Devices, systems, and methods for a frame with a slidable segment are disclosed. The slidable segment (e.g., a window or door) is slidably mounted within the frame (e.g., a window frame or a door frame). A first motor is coupled to the slidable segment. A first pulley is affixed to and driven by the first motor. A first end of a first wire is affixed to a first vertical member of the frame. A second end of the first wire is affixed to a second vertical member of the frame. The first wire wraps around the first pulley at least once. Driving the first pulley in a first direction causes the first pulley to pull on the first vertical member such that the slidable segment slides towards the first vertical member. Driving the first pulley in a second direction causes the first pulley to pull on the second vertical member such that the slidable segment slides towards the second vertical member.

A second motor may be coupled to the slidable segment. A second pulley may be affixed to the slidable segment and driven by the second motor. A first end of the second wire may be affixed to the first vertical member of the frame and a second end of the second wire may be affixed to the second vertical member of the frame. The second wire may wrap around the second pulley at least once. The first motor and the second motor may be oriented anti-parallel to each other. Driving the second pulley in the second direction causes the second pulley to pull on the first vertical member, in conjunction with the first pulley, such that the slidable segment slides towards the first vertical member. Driving the second pulley in the first direction causes the second pulley to pull on the second vertical member, in conjunction with the first pulley, such that the slidable segment slides towards the second vertical member. The first motor may be coupled to a bottom portion of the slidable segment and the second motor may be coupled to a top portion of the slidable segment.

The frame may be a window frame or a door frame. The frame may have a fixed segment offset from the slidable segment such that the slidable segment can slide past the fixed segment.

The first motor may include one or more communication systems, including Bluetooth communication chips, Internet Wi-Fi transceivers, network transceivers, a Z-Wave network transceiver, or a combination thereof. The one or more communication systems may communicate with an external remote controller. The one or more communication systems may receive instructions from the external remote controller, generate signals instructing the first motor to rotate in a direction, receive signals from the first motor regarding a status of the first motor, and generate a signal informing the external remote controller of the status of the first motor. The motor may be powered by one or more batteries or by an electrical power line.

BRIEF DESCRIPTION OF THE DRAWINGS

In order that the advantages of the described devices, systems, and methods will be readily understood, a more particular description of the described devices, systems, and methods briefly described above will be rendered by reference to specific embodiments illustrated in the appended drawings. Understanding that these drawings depict only typical embodiments of the described devices, systems, and methods and are not therefore to be considered limiting of its scope, the devices, systems, and methods will be described and explained with additional specificity and detail through use of the accompanying drawings, in which.

DETAILED DESCRIPTION

It will be readily understood that the components of the described devices, systems, and methods, as generally described and illustrated in the Figures herein, could be arranged and designed in a wide variety of different configurations. Thus, the following more detailed description of the embodiments of the described devices, systems, and methods, as represented in the Figures, is not intended to limit the scope of the described devices, systems, and methods, as claimed, but is merely representative of certain examples of presently contemplated embodiments in accordance with the described devices, systems, and methods.

Automatic opening and closing of sliding windows and sliding doors generally requires planning ahead and use of frames that are designed specifically for automatic sliding doors and automatic sliding windows. However, when automation of an existing installation is desired, a complete replacement of the existing frame is costly and requires more construction skill than the typical homeowner possesses. The devices, systems, and methods disclosed herein disclosed provide solutions to this issue. A motor installed on the sliding segment of the door or window is coupled by a pulley to a wire. The wire extends between the vertical members of the frame. Rotation of the pulley pulls on the wire, causing the sliding segment to move from closed to open and back again. This solution is cost effective and requires minimal construction skill.

Herein, the term 'wire' refers to wire, string, cable, thread, bead chains, chains, links, or any other similar object that may be used in a pulley.

Figure 1A:
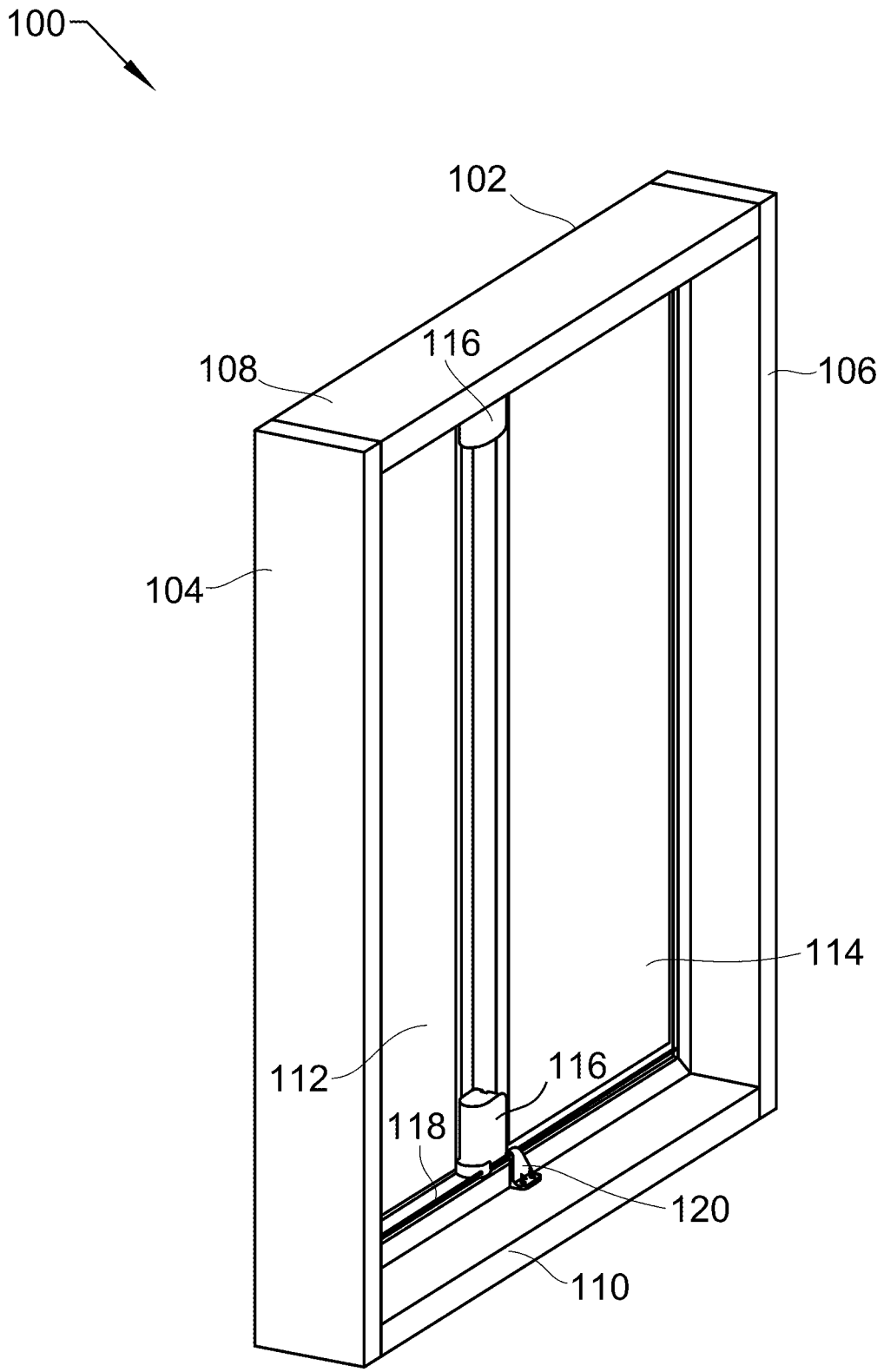
FIG. 1A shows an isometric top-left view of a motorized sliding segment in a frame.
Figure 1B:
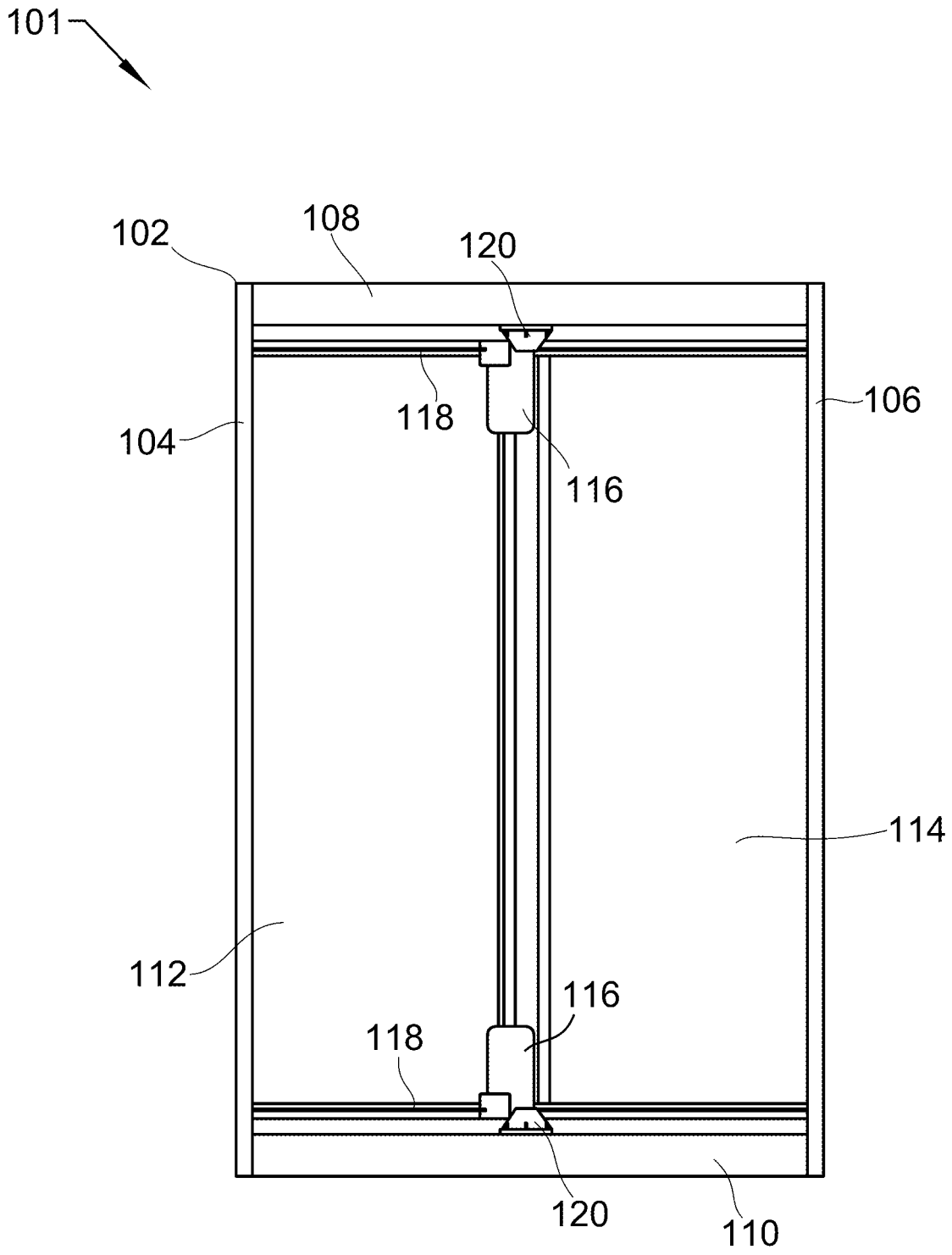
FIG. 1B shows a front isometric view of the frame of FIG. 1A.

Referring now to the Figures, FIG. 1A shows an isometric top-left view 100 of a motorized sliding segment 114 mounted slidably in a frame 102 that may be used in the described devices, systems, and methods. FIG. 1B shows a front isometric view of the frame of FIG. 1A. The frame 102 may be a window frame or a door frame. The frame includes a fixed segment 112, top horizontal member 108, bottom horizontal member 110, left vertical member 104, and right vertical member 106. The track for the sliding segment 114 is offset from the fixed segment 112 so that the sliding segment can open and close. It is appreciated that before the addition of any motor assemblies 116, the sliding segment 114 is manually operated (the sliding segment 114 and frame 102 may be "dumb" or non-smart devices).

Motor assemblies 116 are affixed to the top and/or bottom of the left side of the sliding segment 114. Although two motor assemblies 116 are shown in FIG. 1, any number of motor assemblies 116 may be used, including just one as illustrated in FIG. 3. While the left side is identified, it is appreciated that a motor assembly 116 may be affixed to any location on the sliding segment 114 without departing from the scope of the present systems, devices, and methods. Motor assemblies 116 contain a motor and a pulley, as described in FIG. 2. One end of each of the wires 118 is affixed to the left or right vertical member 104 or 106, wrapped around the pulley at least once, and then the other end of the wires 118 is affixed to the other vertical member. Wire guides 120 are installed to keep the wires in place as the motors moves the sliding segment 114 back and forth across the frame. The motors turn the pulleys in a first direction, causing the pulleys to pull on one of the vertical members via the wires 118, causing the slidable segment 114 to slide towards this vertical member. Rotation the opposite direction pulls on the opposing vertical member, pulling the slidable segment the other direction. In this sense, the pulleys are pulling on the wires 118 whichever direction they turn, while the force translated to the sliding segment 114 is a pull when opening the sliding segment 114, and a push when closing the sliding segment 114. In the present instance, the motor assemblies 116 are mirror images of one another, and so the motors turn opposite each other to pull the same direction. In other words, the motors are antiparallel to each other.

Figure 2:
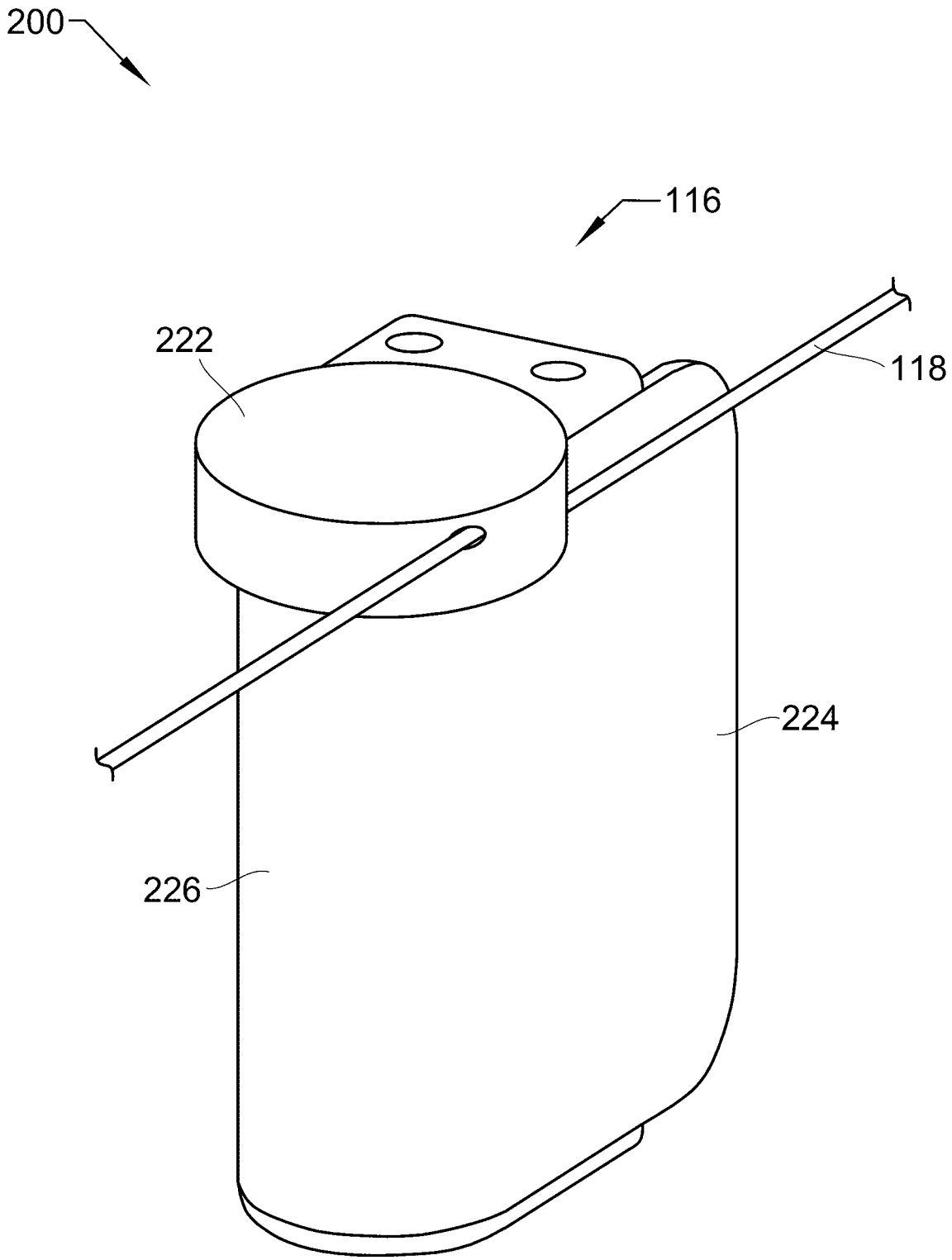
FIG. 2 shows an isometric view of one of the motor assemblies of FIG. 1A.

Referring to FIG. 2, FIG. 2 shows an isometric view 200 of one of the motor assemblies 116 of FIG. 1A. The motor assembly 116 has a mounting section 224 to mount the assembly to the sliding segment 114. The motor is contained in the motor housing section 226. The pulley, attached to the motor, is located in the pulley housing 222.

Figure 3A:
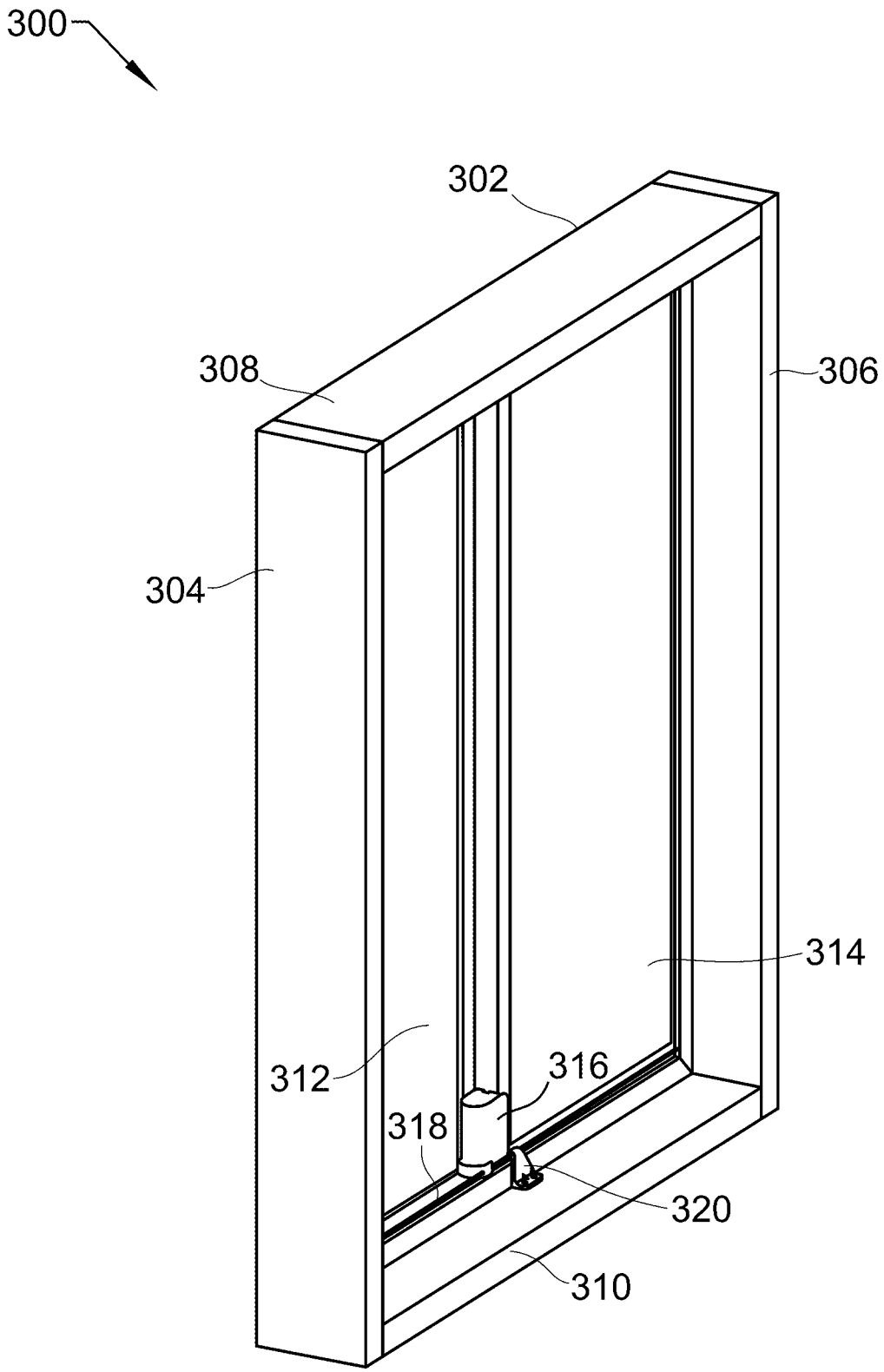
FIG. 3A shows an isometric top-left view of a motorized sliding segment in a frame.
Figure 3B:
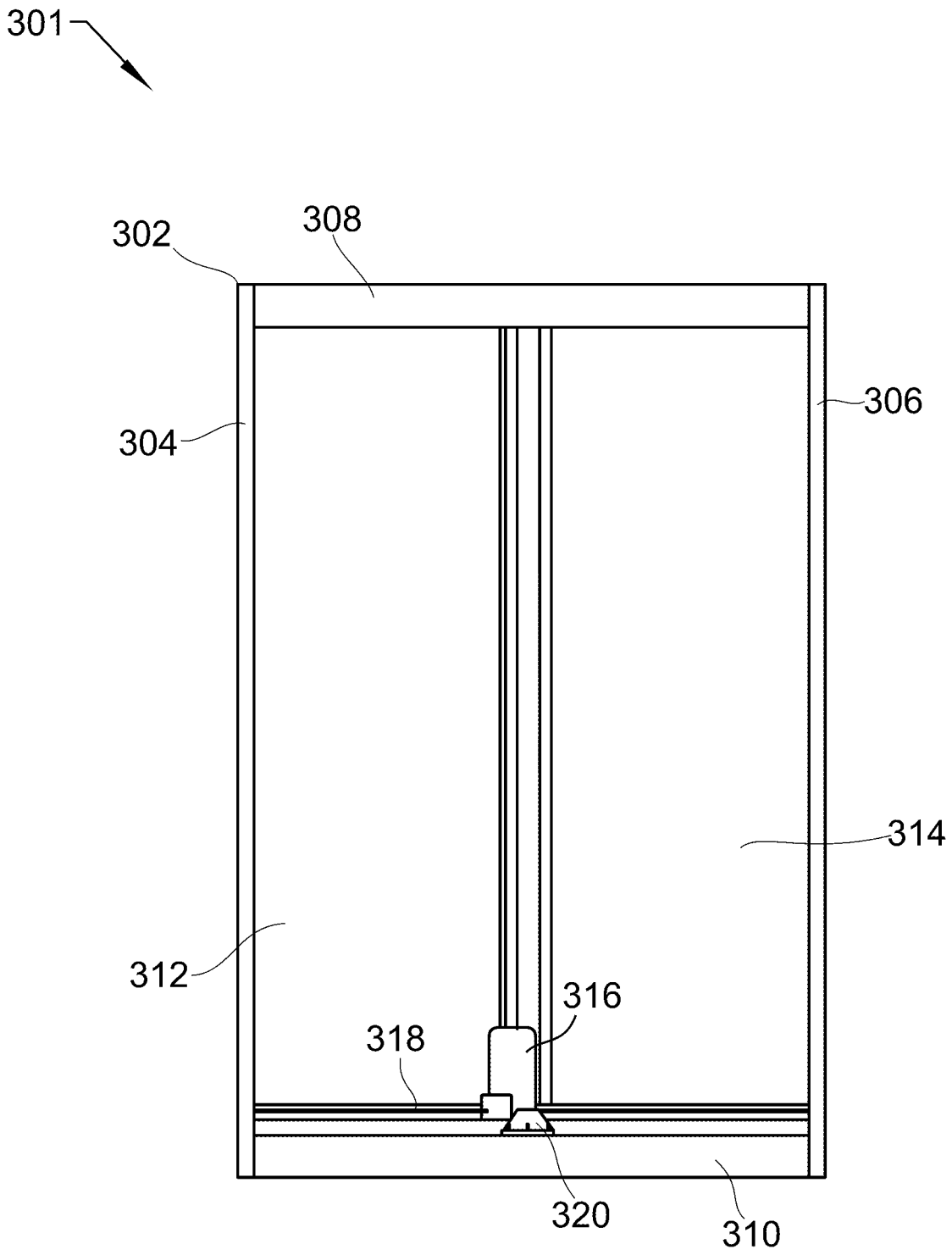
FIG. 3B shows a front isometric view of the frame of FIG. 3A.

Referring to FIG. 3, FIG. 3A shows an isometric top-left view 300 of a motorized sliding segment 314 mounted slidably in a frame 302 that may be used in the described devices, systems, and methods. FIG. 3B shows a front isometric view of the frame of FIG. 2A. The frame 302 may be a window frame or a door frame. The frame includes a fixed segment 312, top horizontal member 308, bottom horizontal member 310, left vertical member 304, and right vertical member 306. The track for the sliding segment 314 is offset from the fixed segment 312 so that the sliding segment can open and close.

Motor assembly 316 is affixed to the bottom of the left side of the sliding segment 314. Motor assembly 316 contains a motor and a pulley, as described in FIG. 2. In some embodiments, the motor assembly 316 is an example of the motor assembly 116 illustrated in FIGS. 1 and 2. One end of the wire 318 is affixed to the left or right vertical member 304 or 306, wrapped around the pulley at least once, and then the other end of the wire 318 is affixed to the other vertical member. Wire guide 320 is installed to keep the wire in place as the motor moves the sliding segment 314 back and forth across the frame. The motor turns the pulley in a first direction, causing the pulley to pull on one of the vertical members via the wire 318, causing the slidable segment to slide towards this vertical member. Rotation the opposite direction pulls on the opposing vertical member, pulling the slidable segment the other direction. In this sense, the pulley is pulling on the wire 318 whichever direction they turn, while the force translated to the sliding segment 314 is a pull when opening the sliding segment 314, and a push when closing the sliding segment 314.

In some embodiments, the motor assembly 316 includes a transmission (not shown). The transmission may include one or more gears that convert rotational speed to rotational torque for driving the pulley that pulls the wire. In some cases, the transmission is configured such that the transmission can only be driven by the motor of the motor assembly 316 (cannot be driven by the pulley, for example). For instance, the transmission may include a worm gear that may be driven by the motor to drive the pulley, but that locks the pulley in place when the motor is not spinning (the pulley cannot be used to turn the worm gear, for example). Thus, the transmission locks the slidable segment 314 in place in whatever position the slidable segment 314 is in (assuming the wire is wrapped around the pulley such that there is no slippage between the wire and the pulley, for example). So in contrast to typical locking mechanisms that only lock a slidable segment when the slidable segment is in a closed position, the transmission locks the pulley in place along the wire in whatever place along the wire that the pulley is at. So the slidable segment 314 may be locked in place when the slidable segment 314 is closed as with typical locking mechanisms but could also lock the slidable segment 314 in place when the slidable segment 314 is any degree of partly open or even fully opened. This feature may allow for the slidable segment 314 to be partly opened, while still providing security that the slidable segment 314 cannot be opened further or closed outside of an authorized user's control (when the motor is driven, for example).

Figure 4:
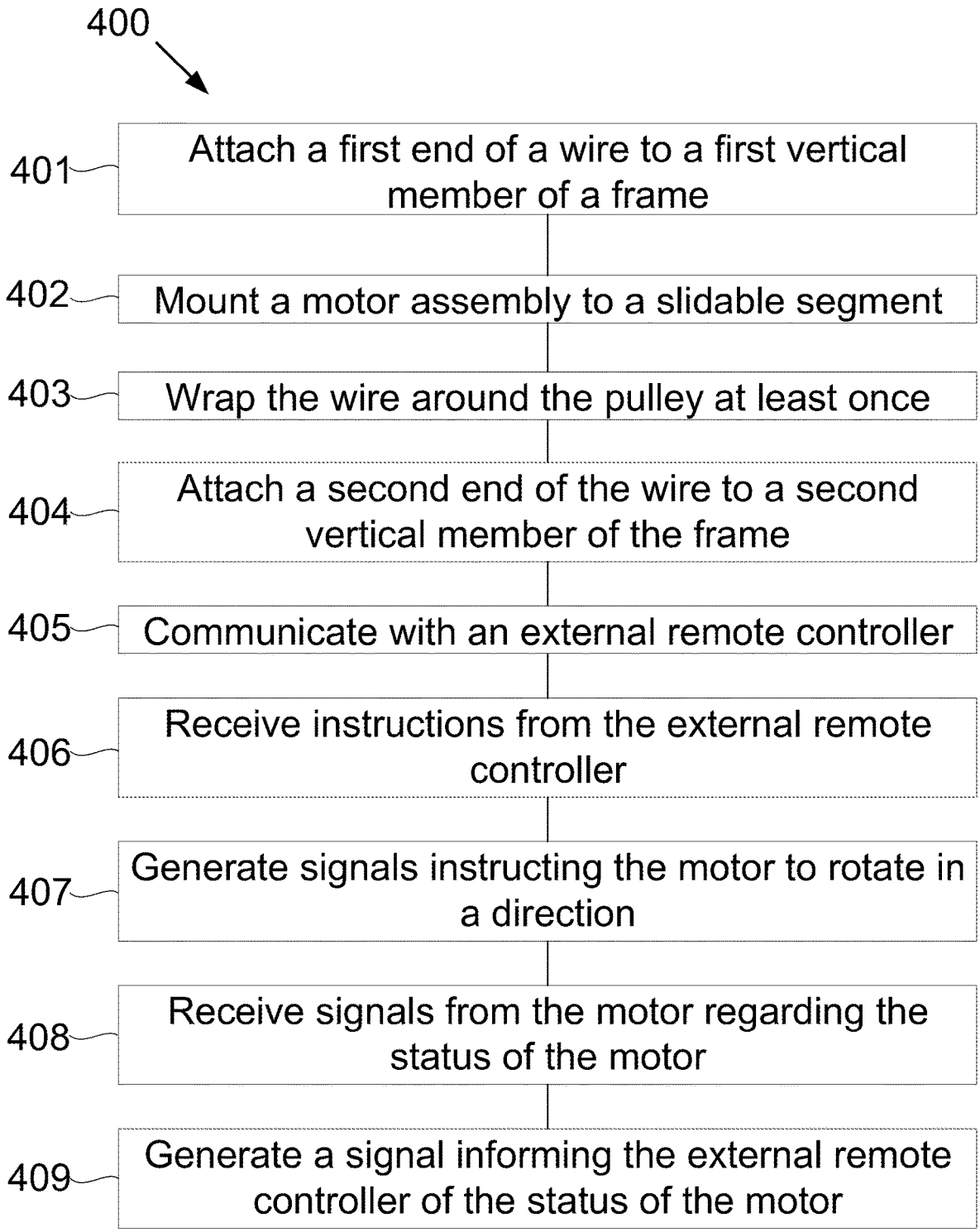
FIG. 4 shows a method for automating a slidable segment of a frame.

Referring to FIG. 4, FIG. 4 shows a method 400 for automating a slidable segment of a frame using the described devices, systems, and methods. At 401, a first end of a wire is attached to a first vertical member of a frame. At 402, a motor assembly is mounted to a slidable segment, the slidable segment being slidably mounted within the frame. The motor assembly comprises a motor turning a pulley. At 403, the wire wraps around the pulley at least once. At 404, a second end of the wire is attached to a second vertical member of the frame. The motor has one or more communication systems. At 405, the one or more communication systems communicate with an external remote controller. At 406, the one or more communication systems receive instructions from the external remote controller. At 407, the one or more communication systems generate signals instructing the motor to rotate in a direction. At 408, the one or more communication systems receive signals from the motor regarding a status of the motor. At 409, the one or more communication systems generate a signal informing the external remote controller of the status of the motor.

Although the operations of method 400 are illustrated as being performed in a particular order, it is understood that the operations of method 400 may be reordered without departing from the scope of the method.

In some embodiments, the first motor includes one or more communication systems. These may include Bluetooth communication chips, Internet Wi-Fi transceivers, network transceivers, a Z-Wave network transceiver, or a combination thereof. In some embodiments, the one or more communication systems communicate with an external remote controller. In some embodiments, the one or more communication systems receive instructions from the external remote controller, generate signals instructing the first motor to rotate in a direction, receive signals from the first motor regarding a status of the first motor, and generate a signal informing the external remote controller of the status of the first motor.

In some embodiments, the motor has and is powered by one or more batteries. In other embodiments, the motor has and is powered by a power line.

In some embodiments, the slidable segment is slidably mounted by being between tracks on a top horizontal member of the frame and a bottom horizontal member of the frame, the tracks allowing the slidable frame to freely move side to side.

In some embodiments, the frame has a latching device that mates to a latching receiver attached to the slidable segment, wherein mating prevents movement of the slidable segment. In some embodiments, the latching receiver comprises a communication device that generates a signal when the latching device is mated and transmits that signal to the motor, wherein the signal deactivates the motor.

In some embodiments, the first end and the second end of the wire may be attached by adhesive, hooks, screws, loops, or a combination thereof. In some embodiments, the motor assembly may be mounted to the slidable segment by adhesive, screws, nails, or a combination thereof.

In some embodiments, a groove of the pulley may be smooth or toothed.

In some embodiments, the second end of the wire may be attached to the second vertical member of the frame by a tensioning device. The tensioning device may be permanently attached and capable of re-tensioning the wire as the wire loses tension over time.

The invention claimed is:

1. A device comprising:

a frame and a slidable window that is slidably mounted within the frame, the slidable window having a lateral surface perpendicular to a direction of movement of the slidable window and a front surface perpendicular to the lateral surface, a first motor assembly having a mounting section that contacts a portion of the lateral surface and a portion of the front surface, the mounting section being retrofittably mounted to the slidable window, a first pulley contained by the first motor assembly and driven by the first motor assembly, a first wire, wherein a first end of the first wire is retrofittably mounted on an exterior surface of the a first vertical member of the frame and a second end of the first wire is retrofittably mounted on an exterior surface of the a second vertical member of the frame, and wherein the first wire wraps around the first pulley at least once, wherein driving the first pulley in a first direction causes the first pulley to pull on the first vertical member such that the slidable window slides towards the first vertical member, and wherein driving the first pulley in a second direction causes the first pulley to pull on the second vertical member such that the slidable window slides towards the second vertical member.

2. The device of claim 1, further comprising a second motor assembly coupled to the slidable window, a second pulley affixed to and driven by the second motor assembly, and a second wire, wherein a first end of the second wire is affixed to the first vertical member of the frame and a second end of the second wire is affixed to the second vertical member of the frame, and wherein the second wire wraps around the second pulley at least once.

3. The device of claim 2, wherein:

the first motor assembly and the second motor assembly are oriented co-linear to each other with shafts facing opposite directions, driving the second pulley in the second direction causes the second pulley to pull on the first vertical member, in conjunction with the first pulley, such that the slidable window slides towards the first vertical member, and driving the second pulley in the first direction causes the second pulley to pull on the second vertical member, in conjunction with the first pulley, such that the slidable window slides towards the second vertical member.

4. The device of claim 3, wherein the first motor assembly is coupled to a bottom portion of the slidable window and the second motor is coupled to a top portion of the slidable window.

5. The device of claim 1, wherein the frame comprises a window frame.

6. The device of claim 1, wherein the frame further comprises a fixed segment offset from the slidable window such that the slidable window can slide past the fixed segment.

7. The device of claim 1, wherein the first motor assembly comprises one or more communication systems comprising Bluetooth communication chips, Internet Wi-Fi transceivers, network transceivers, a Z-Wave network transceiver, or a combination thereof, and wherein the one or more communication systems communicate with an external remote controller.

8. The device of claim 1, wherein the first motor assembly includes a transmission that drives the first pulley, wherein the transmission prevents the first pulley from rotating when the transmission is not driven by the motor such that the transmission locks the slidable window in place when the transmission is not driven by the first motor assembly, and wherein the transmission comprises a worm gear, the worm gear preventing the first pulley from rotating when the transmission is not driven by the first motor assembly.

9. The device of claim 7, wherein the one or more communication systems receive instructions from the external remote controller, generate signals instructing the first motor assembly to rotate in a direction, receive signals from the first motor assembly regarding a status of the first motor assembly, and generate a signal informing the external remote controller of the status of the first motor assembly.

10. The device of claim 1, wherein the first motor assembly further comprises one or more batteries, a power line, or a combination thereof, wherein the first motor assembly is powered by the one or more batteries, by the power line, or by a combination thereof.

11. The device of claim 1, wherein the slidable window is slidably mounted by being between tracks on a top horizontal member of the frame and a bottom horizontal member of the frame, the tracks allowing the slidable frame to freely move side to side.

12. The device of claim 1, wherein the frame comprises a latching device that mates to a latching receiver attached to the slidable window, wherein mating prevents movement of the slidable window.

13. The device of claim 12, wherein the latching receiver comprises a communication device that generates a signal when the latching device is mated and transmits that signal to the first motor assembly, wherein the signal deactivates the first motor assembly.

* * * * *